US011428054B2

(12) United States Patent
Grindhaug et al.

(10) Patent No.: US 11,428,054 B2
(45) Date of Patent: Aug. 30, 2022

(54) MECHANICAL COUPLING OF TUBULARS

(71) Applicant: EQUINOR ENERGY AS, Stavanger (NO)

(72) Inventors: Gaute Grindhaug, Hafrsfjord (NO); Erling Grindhaug, Harstad (NO); Morten Eidem, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 17/625,516

(22) PCT Filed: Jun. 12, 2020

(86) PCT No.: PCT/NO2020/050157
§ 371 (c)(1),
(2) Date: Jan. 7, 2022

(87) PCT Pub. No.: WO2021/006741
PCT Pub. Date: Jan. 14, 2021

(65) Prior Publication Data

US 2022/0205325 A1 Jun. 30, 2022

(30) Foreign Application Priority Data

Jul. 8, 2019 (GB) ..... 1909755
Apr. 22, 2020 (GB) ..... 2005866

(51) Int. Cl.
*E21B 17/042* (2006.01)
*E21B 19/16* (2006.01)
*E21B 17/02* (2006.01)

(52) U.S. Cl.
CPC ..... *E21B 17/042* (2013.01); *E21B 17/028* (2013.01); *E21B 19/16* (2013.01)

(58) Field of Classification Search
CPC ..... E21B 17/042; E21B 17/028; E21B 19/16
See application file for complete search history.

(56) References Cited

U.S. PATENT DOCUMENTS 3,829,816 A * 8/1974 Barry ..... E21B 17/028 285/414
5,997,045 A 12/1999 Bøe et al.
(Continued)

FOREIGN PATENT DOCUMENTS

CN 105525880 A 4/2016
EP 0060549 A1 9/1982

OTHER PUBLICATIONS

International Search Report, issued in PCT/NO2020/050157, PCT/ISA/210, dated Aug. 13, 2020.
(Continued)

*Primary Examiner* — David Carroll
(74) *Attorney, Agent, or Firm* — Birch, Stewart, Kolasch & Birch, LLP

(57) ABSTRACT

A tubular for use in the creation or completion of, or production from, an oil and/or gas well. The tubular comprises; an elongate main body; a stab-in connector element located at an end of the main body; and a rotatable connection sleeve disposed coaxially around a first end portion of the main body at or near said end of the main body. The connection sleeve is configured to provide a mechanical coupling between the tubular and another tubular without requiring rotation of the main body, to thereby provide a stab-in connection between the stab-in connector element of the tubular and a complementary stab-in connector element of the other tubular for electrical power and/or data transmission.

12 Claims, 7 Drawing Sheets

(56) References Cited

U.S. PATENT DOCUMENTS

| | | | | |
|---|---|---|---|---|
| 2005/0023831 | A1* | 2/2005 | Hughes | E21B 17/028 285/332 |
| 2005/0205304 | A1* | 9/2005 | Gurjar | E21B 47/017 175/320 |
| 2013/0008669 | A1* | 1/2013 | Deere | E21B 17/028 166/65.1 |
| 2015/0176341 | A1 | 6/2015 | Hughes et al. | |

OTHER PUBLICATIONS

Search Report issued in GB priority application 2005866.5, dated Sep. 29, 2020.
Written Opinion of the International Searching Authority, issued in PCT/NO2020/050157, PCT/ISA/237, dated Aug. 13, 2020.

* cited by examiner

S702

For a tubular comprising an elongate main body, a stab-in connector element located at an end of the main body, and a rotatable connection sleeve disposed coaxially around a first end portion of the main body at or near said end of the main body, and another tubular comprising a complementary stab-in connector element, using the connection sleeve to provide a mechanical coupling between the tubular and the other tubular without requiring rotation of the main body, to thereby provide a stab-in connection between the stab-in connector element of the tubular and a complementary stab-in connector element of the other tubular for electrical power and/or data transmission

Figure 7

MECHANICAL COUPLING OF TUBULARS

TECHNICAL FIELD

The present invention relates to the mechanical coupling of tubulars, for example wired drill pipe sections or wired casing/liner sections.

BACKGROUND

A drill string typically includes a plurality of drill pipe sections joined together end to end. More pipe sections may be added to extend the drill string. Production tubing, liners, casings, or any other type of tubular string or piping used in an oil and/or gas well (or in the creation of such a well) also typically comprises a plurality of similar, or substantially identical, tubulars joined end to end. It is often necessary to transmit data downhole along such a tubular string, for example to sensors located at or near the end of the tubular string. Wired tubular sections (e.g. wired drill pipe) can be used to achieve this, and it is necessary to provide a means of connecting the tubular sections to allow the transmission of data along the tubular string. Existing technologies are typically not able to support the transmission of power.

SUMMARY OF INVENTION

It is an object of the present invention to overcome or at least mitigate the problems identified above.

In accordance with a first aspect of the present invention there is provided a tubular for use in the creation or completion of, or production from, an oil and/or gas well, comprising; an elongate main body; a stab-in connector element located at an end of the main body; and a rotatable connection sleeve disposed coaxially around a first end portion of the main body at or near said end of the main body. The connection sleeve is configured to provide a mechanical coupling between the tubular and another tubular without requiring rotation of the main body, to thereby provide a stab-in connection between the stab-in connector element of the tubular and a complementary stab-in connector element of the other tubular for electrical power and/or data transmission.

The tubular may further comprise: a first shoulder located at the first end portion of the main body and extending radially outward from the first end portion to provide a first abutment surface, wherein the connection sleeve is longitudinally movable relative to the main body. The connection sleeve comprises: an internal screw thread; and a second shoulder located at a proximal end portion of the connection sleeve and extending radially inward from an inner surface of the connection sleeve to provide a second abutment surface that is configured to engage with the first abutment surface. The mechanical coupling is provided by rotating the connection sleeve to engage the internal screw thread of the connection sleeve with an external screw thread of the other tubular, to thereby draw the stab-in connector element of the tubular into engagement, or further engagement, with the complementary stab-in connector element of the other tubular.

The tubular may further comprise a first external screw thread in the first end portion, wherein the first external thread is configured to engage with the internal screw thread of the connection sleeve to retain the connection sleeve in place on the main body. The internal screw thread may extend a distance from a distal end of the connection sleeve such that, when engaged with an external thread of another tubular, the internal screw thread is not engaged with the first external thread of the tubular.

The tubular may further comprise: a complementary stab-in connector element located at the other end of the main body; and a second external screw thread in a second end portion of the main body at or near the other end of the main body.

The stab-in connector element of the tubular may be a male plug or pin, or a female socket, and the complementary stab-in connector element may be a corresponding female socket or a male plug or pin.

The stab-in connector element and the complementary stab-in connector element may have complementary tapered shapes.

The tubular may further comprise, at said end of the main body, a circumferential recessed lip that is configured to engage with a corresponding protruding portion of another tubular to provide a pressure seal.

The tubular may be a drill pipe section, a production tubing section, a liner section, or a casing section.

In accordance with a second aspect of the present invention there is provided a tubular string comprising a plurality of tubulars according to the first aspect mechanically coupled end-to-end.

In accordance with a third aspect of the present invention there is provided a method of mechanically coupling a tubular to another tubular, wherein the tubular comprises an elongate main body, a stab-in connector element located at an end of the main body, and a rotatable connection sleeve disposed coaxially around a first end portion of the main body at or near said end of the main body; and the other tubular comprises a complementary stab-in connector element. The method comprises: using the connection sleeve to provide a mechanical coupling between the tubular and the other tubular without requiring rotation of the main body, to thereby provide a stab-in connection between the stab-in connector element of the tubular and a complementary stab-in connector element of the other tubular for electrical power and/or data transmission.

The tubular may further comprise a first shoulder located at the first end portion of the main body and extending radially outward from the first end portion to provide a first abutment surface, wherein the connection sleeve is longitudinally movable relative to the main body, the connection sleeve comprising an internal screw thread, and a second shoulder located at a proximal end portion of the connection sleeve and extending radially inward from an inner surface of the connection sleeve to provide a second abutment surface that is configured to engage with the first abutment surface, and the other tubular further comprising an external screw thread. Using the connection sleeve to provide a mechanical coupling between the tubular and the other tubular may comprise: rotating the connection sleeve to engage the internal screw thread of the connection sleeve with the external screw thread of the other tubular, to thereby draw the stab-in connector element of the tubular into engagement, or further engagement, with the complementary stab-in connector element of the other tubular.

Embodiments of the invention will now be described by way of example only and with reference to the accompanying drawings, in which:

BRIEF DESCRIPTION OF DRAWINGS

FIG. 10 shows the connection sleeve of the tubular of FIG. 1A, without the main body.

FIG. 7 shows a high-level flow diagram describing a method in accordance with the invention.

DETAILED DESCRIPTION

Figure 1A:
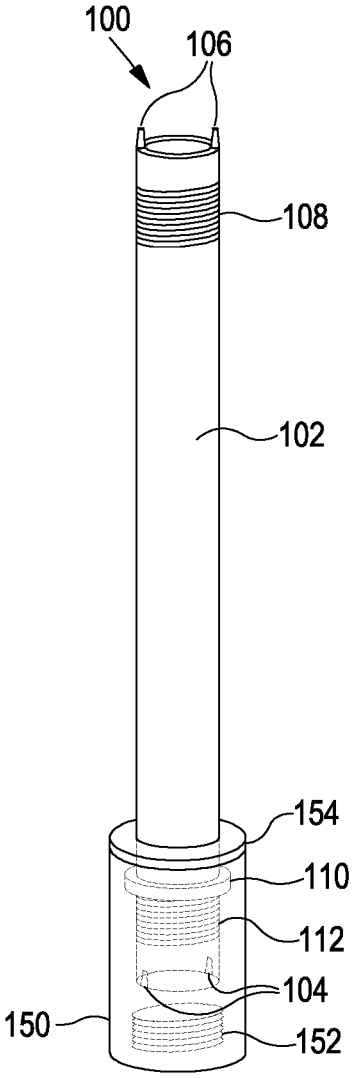
FIG. 1A shows a tubular in accordance with the invention.

The present invention provides a tubular for use in the creation or completion of, or production from, an oil and/or gas well. The tubular comprises an elongate main body, and features that facilitate the mechanical coupling of the tubular to another tubular without requiring rotation of the main body. In particular, the tubular further comprises a stab-in connector element located at an end of the main body, and a rotatable connection sleeve disposed coaxially around a first end portion of the main body at or near said end of the main body. The rotatable connection sleeve can be used to provide a mechanical coupling between the tubular and the other tubular without requiring rotation of the main body, to thereby provide a stab-in connection between the stab-in connector element of the tubular and a complementary stab-in connector element of the other tubular for electrical power and/or data transmission. Avoiding rotation of the main body, and hence avoiding relative rotational movement of the stab-in connection elements, minimises the risk of damage to the connection elements during a connection process. This reduced risk of damage, in combination with the use of sturdy stab-in connector elements, allows a connection process to be performed more quickly. Further, the stab-in connection provides a reliable a sturdy connection to facilitate the reliable and efficient transfer of electrical power and/or data.

In an embodiment in which the tubular is a wired drill pipe section, the fixed socket-type connection between drill pipe joints makes it possible to stab in data and/or power lines. Using a rotating sleeve to make up the connection means that normal offshore equipment such as an iron roughneck can be used to make up connections without having to rotate the drill pipe. This makes it possible to have sturdy pin connections between the joints for transfer of data and or power. The increased robustness may reduce the need for maintenance, and reduce the need for recutting of drill pipe due to damaged connections. The invention provides a more reliable solution than prior art examples using induction coils. Further, it is possible to transmit power through the drill pipe, entirely replacing electricity generating modules in the bottom hole assembly. It is also possible to transmit more power than in existing systems, and the power transmission is independent of drilling mud flow rate. In particular, prior art systems using a 'measurement while drilling' (MWD) package typically have a mud flow rate range (min/max) within which it is possible to generate power, due to the limitations of the turbine(s) used to generate power. In particular, a downhole mud-driven turbine is used to generate electricity for powering the different MWD tools, and the turbine has a minimum and maximum flow range within which it can function. Too little flow means that the tools will not power on, and too high a flow rate means that the tools risk 'burning out'. The flow range can be selected as e.g low flow, medium flow or high flow. Further, the invention imposes no limit on usage time for MWD tools that in prior art systems typically depend on batteries.

Similarly, in an embodiment in which the tubular is a wired production tubing section, a wired liner section or a wired casing section, the fixed socket-type connection between tubular joints makes it possible to stab in data and/or power lines. This provides sturdy pin connections between the joints for transfer of data and or power. The increased robustness may reduce the need for maintenance, and reduce the need for replacing a the tubular due to damaged connections.

Where the tubular is a wired drill pipe section, and multiple tubulars are joined together to provide a wired drill pipe, in an embodiment the resulting power and/or data transmission capabilities of the drill pipe are used to perform completion processes, e.g. for electrically setting a liner, for example by setting slips and one or more packers. In another embodiment, the power and/or data are used for operating sensors, valves and other associated equipment in a bottom hole assembly of a drill pipe.

The invention is particularly advantageous for completion processes. Prior art completion processes rely on hydraulic power provided by hydraulic lines attached to the outside of tubing, or on electrical power provided by downhole batteries. Such hydraulic lines can be easily damaged, require complicated installation processes (e.g. attachment to tubing using clamps), and may complicate plug and abandon operations. In contrast, the invention provides reliable power and/or data connection with much reduce risk of damage, and no issue for plug and abandon operations. Further, the use of surface-provided power provides an extended lifetime to downhole equipment, compared with batteries which have a limited power supply.

Where the tubular is a production tubing section, and multiple tubulars are joined together to provide wired production tubing, in an embodiment the power and/or data transmission capabilities of the wired production tubing are used to perform for controlling e.g. safety valves, pumps, and/or other equipment associated with production.

Where the tubular is a casing section, and multiple tubulars are joined together to provide a wired casing, in an embodiment the power and/or data transmission capabilities of the wired casing are used to power, and collect data from, sensors distributed along the casing. Such sensors may be used e.g. during a process of cementing the casing, or after completion is finished.

Where the tubular is a liner section, and multiple tubulars are joined together to provide a wired liner, in an embodiment the power and/or data transmission capabilities of the wired liner are used to perform tasks during liner setting (e.g. by providing power for the equipment used during liner setting). The power and/or data transmission capabilities may also be used to transmit power and/or data down the liner after completion is finished. In this case an electrical connection between a wired casing and the wired liner is required.

Where tubulars according to the invention are joined to provide a wired casing/liner/production tubing, in an embodiment, the power and/or data transmission capabilities are used for one or more of the following operations:

- Powering and/or collecting data from sacrificial pressure sensors in casing/liner
- Along-string measurements while running completions
- Controlling, powering, and/or collecting data from completion equipment downhole
- Setting liner hangers electrically
- Setting and/or controlling autonomous inflow device (AICD) and/or inflow control valve (ICV) electrically
- Opening plugs (glassplug etc.)
- Operating ball valves in completion/downhole safety valve (DHSV)
- Setting/releasing downhole packers (could potentially replace swellpackers)
- Powering/controlling downhole perforation guns as part of completion
- Electrically operating gravelpack packers
- Powering and/or controlling downhole isolation valves for pressure testing casing (e.g. if failed pressure test on bump)

FIG. 1A shows a tubular 100 in accordance with the invention. In an embodiment the tubular 100 is a drill pipe section, and in particular a wired drill pipe section. In an alternative embodiment the tubular is any suitable pipe, tubular, or flowline section for use in the creation or completion of, or production from, an oil/and or gas well, e.g. a casing section, a liner section, or a production tubing section. In such an alternative embodiment the pipe, tubular or flowline section is optionally a wired pipe, tubular or flowline section.

Figure 1B:
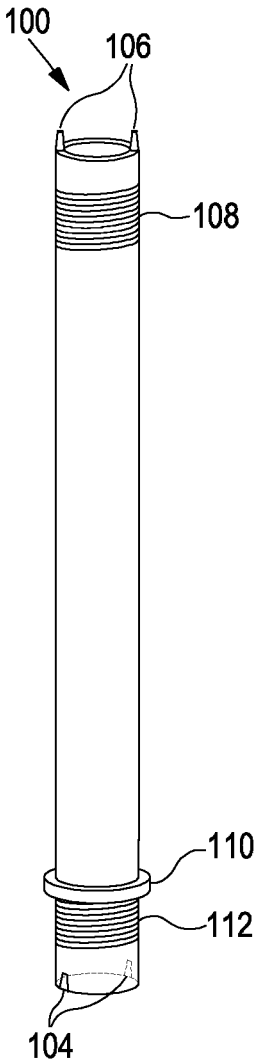
FIG. 1B shows the main body of the tubular of FIG. 1A, without the connection sleeve.
Figure 1C:
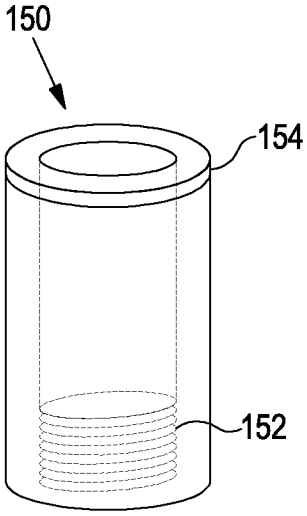

The tubular has an elongate main body 102. To more clearly show the features of the elongate main body, FIG. 1B shows the elongate main body alone, in the absence of the rotatable connection sleeve 150 (which is described below). One or more stab-in connector elements 104 are located at an end of the main body 102. In the embodiment shown in FIG. 1A the stab-in connector elements 104 at said end of the main body are two female sockets. Alternatively, one, three, or a greater number of stab-in connector elements are used as required, and male pin(s) or plug(s) are used instead of the female sockets. In the case that there are two or more stab-in connector elements at one end of the main body, any combination of female sockets and male pins or plugs can be used, e.g. one female socket and two male pins or plugs.

A rotatable connection sleeve 150 is disposed coaxially around a first end portion of the main body, where the first end portion of the main body is located at or near said end of the main body 102. The first end portion optionally includes a first external screw thread 112, which is described in more detail below with reference to FIG. 2. FIG. 10 shows an enlarged view of the connection sleeve, in the absence of the elongate main body 102. The connection sleeve is for facilitating a mechanical coupling between the tubular and another tubular having complementary stab-in connector elements. The connection sleeve 150 is longitudinally and rotatably movable relative to the main body 102. Longitudinal movement of the connection sleeve towards said end of the main body is limited by the engagement of the connection sleeve with a first shoulder 110 of the tubular. The first shoulder 110 is located at the first end portion of the main body, and extends radially outward from the first end portion to provide a first abutment surface. The connection sleeve has an opening at a distal end configured to receive another tubular. The other, proximal end of the connection sleeve has an aperture defined by an end surface of the connection sleeve, through which the main body of the tubular extends. The end surface provides a second shoulder 154 that extends radially inward from an inner surface of the connection sleeve to provide a second abutment surface. The second abutment surface is configured to engage with the first abutment surface, to thereby limit the longitudinal motion of the connection sleeve towards said end of the main body.

When the connection sleeve is in a distal position, i.e. when the first and second abutment surfaces are engaged and the connection sleeve cannot move any further towards said end of the main body (as shown in FIG. 1A), the connection sleeve extends beyond said end of the main body. The portion of the connection sleeve that extends beyond the main body is configured to surround another tubular when the tubular is mechanically coupled to the other tubular, and includes features that facilitate the mechanical coupling to the other tubular. In particular, in the embodiment shown in FIGS. 1A and 10, the connection sleeve comprises an internal screw thread which is configured to engage with an external screw thread of another tubular, to thereby provide the mechanical coupling to the other tubular. A screw thread coupling is advantageous because typical make-up and break-out procedures and equipment are adapted for rotational couplings. Use of a tubular in accordance with the invention may therefore require no, or minimal, modification of existing procedures and apparatus. Whilst it is envisaged that the mechanical coupling will be achieved using screw thread couplings, any other suitable mechanical coupling means could be used. For example, a clip-on connection sleeve in the tubular could be configured to engage with a corresponding groove in another tubular, or a connection sleeve with an expandable seal could be configured to engage with an outer surface of another tubular.

Complementary stab-in connector elements 106 are located at the other end of the main body, i.e. at the opposite end of the main body from said end of the main body. It is envisaged that multiple similar or substantially identical tubulars in accordance with the invention will be joined end-to-end, and in such an embodiment each tubular will have a certain configuration of stab-in connectors at one end, and a complementary configuration of stab-in connectors at the other end. In FIGS. 1A and 1B the complementary stab-in connector elements 106 are two male pins, which are complementary to the two female plugs 104 at said end of the main body, and will fit with the female plugs of another similar or substantially identical tubular to be coupled above the tubular 100. In line with the description above of the stab-in connector elements 104, any suitable configuration of complementary stab-in connector elements 106 is possible, as long as the configuration is complementary with reference to the stab-in connector elements 104. The elongate main body has a second end portion at or near the other end of the main body. The second end portion includes a second external screw thread 108 that is configured to engage with an internal screw thread of a connection sleeve of another tubular. If required, a tubular in accordance with the invention may have no stab-in connection elements 106 or second external screw thread 108 at the other end of the main body, or may have different connection features as required to connect to another entity which is not a tubular having corresponding stab-in connector elements. The tubular optionally has a third shoulder in the second end portion (not shown in the Figures) to enable handling with an elevator, in line with standard practice for e.g. a typical drill pipe.

Figure 2:
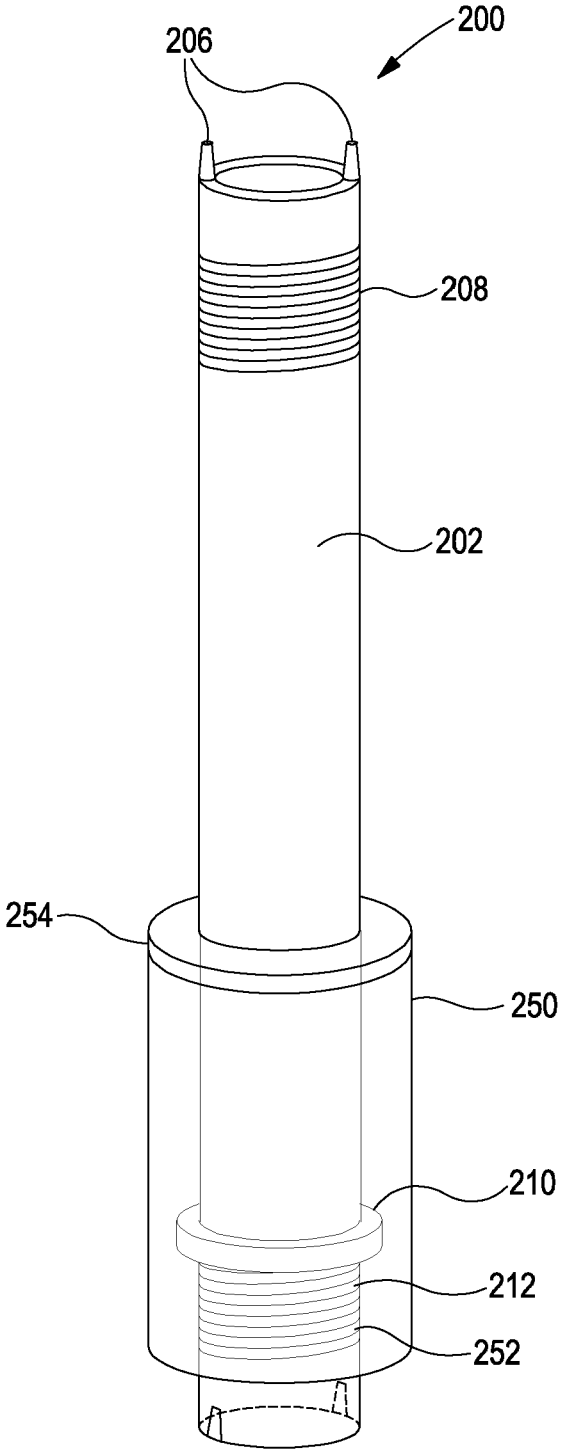
FIG. 2 shows a configuration of the tubular of FIG. 1A in which the connection sleeve is retained in position.

FIG. 2 shows the tubular of FIG. 1A with the connection sleeve in a different position. Like features are indicated by reference numerals incremented by one hundred. In FIG. 2 the connection sleeve 250 is in a proximal position. That is, the connection sleeve is not in the distal position, i.e. the first abutment surface provided by the first shoulder 210 is not engaged with the second abutment surface provided by second shoulder 254, and the connection sleeve 250 does not extend beyond said end of the elongate main body 202. To hold the connection sleeve in the proximal position, the internal screw thread 252 of the connection sleeve is engaged with the first external screw thread 212 of the elongate main body. The connection sleeve may be held in the proximal position during transportation, handing and storage before being made up to another tubular, and/or during the initial stages of a make-up procedure. During a break-out procedure, the internal screw thread may be brought out of engagement with an external screw thread of another tubular, and subsequently into engagement with the first external screw thread of the tubular. The connection sleeve may then be held in the proximal position during subsequent steps of the break-out procedure and further transport. Holding the connection sleeve in the proximal position may prevent damage to the connection sleeve, the tubular or other equipment that could result from unrestrained movement of the connection sleeve during e.g. handling and racking of the tubular.

In one embodiment the internal screw thread 152,252 of the connection sleeve extends a distance from the distal end of the connection sleeve such that, when engaged with an external thread of another tubular, the internal screw thread is not engaged with the first external thread 112,212 of the tubular. This means that the internal screw thread does not extend for the entire length of the connection sleeve. In particular, the span of the internal screw thread 152,252 in the longitudinal direction (i.e. along the longitudinal axis of the connection sleeve, which is also the longitudinal axis of the tubular) is shorter than, or equal to, the distance between the first external thread 112,212 of the tubular and the external thread of another tubular, when the stab-in connector elements of the tubular are in full engagement with the stab-in connector elements of the other tubular. The span of the internal screw thread, the location of the first external thread and the location of external thread of the other tubular can be configured in any suitable combination to achieve the required effect. For example, if the first external thread is more distant from said end of the main body, and/or the external thread of the other tubular is more distant from the end of the other tubular that is to be mechanically coupled to the tubular, the span of the internal screw thread can be longer.

This means that when the tubular is mechanically coupled to another tubular, the only movement-limiting engagement between the connection sleeve and the tubular is the engagement of the first shoulder with the second shoulder. When the internal thread of the connection sleeve is further engaged with the external thread of the other tubular, the mechanical engagement of the first and second shoulders will "drag" the tubular towards the other tubular until the end areas of the two tubulars are pushed together, providing a pressure seal as the two ends are forced together.

Figure 3:
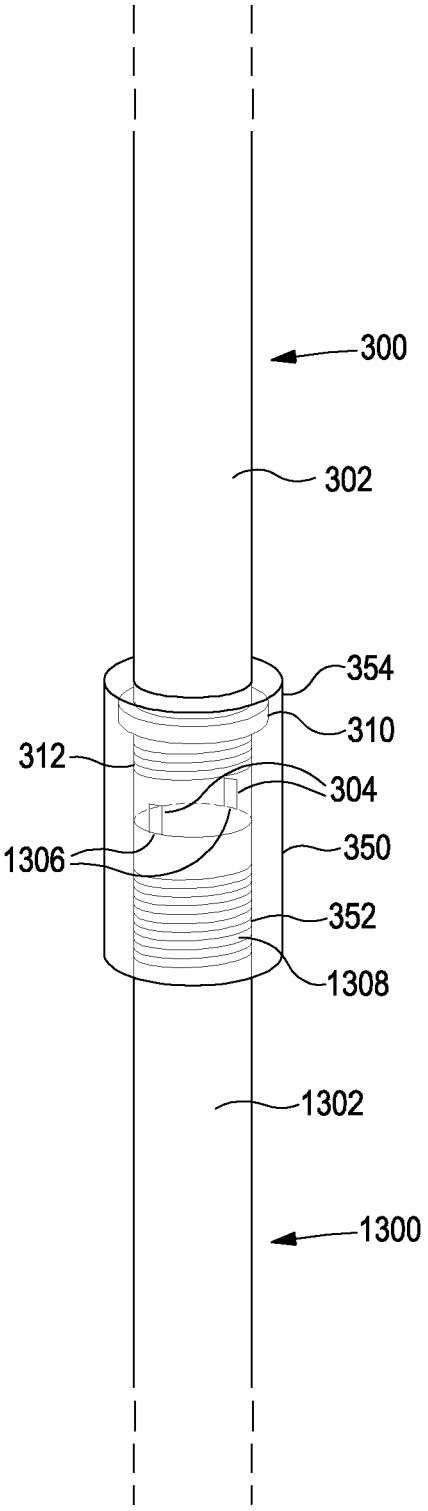
FIG. 3 shows the tubular of FIG. 1A mechanically coupled to another tubular.

FIG. 3 shows a tubular 300 in accordance with the invention, e.g. the tubular shown in FIG. 1A, mechanically coupled to another tubular 1300. Like features of the tubular 300 relative to the tubular of FIG. 1A are indicated using reference numerals incremented by two hundred. Features that would in practice be obscured by the connection sleeve 350 are shown as visible in FIG. 3. The connection sleeve 350 is in the distal position such that the abutment surface provided by the first shoulder 310 and the abutment surface provided by the second shoulder 354 are engaged. The internal screw thread 352 of the connection sleeve 350 is engaged with an external screw thread 1308 of the other tubular, and is not engaged with the first external screw thread 312 of the tubular 300. The stab-in connector elements 304 of the tubular 300, which in this case are female sockets, are engaged with the complementary stab-in connector elements 1306 of the other tubular 1300, for providing electrical data and/or power transmission via the stab-in connection of the tubular 300 with the other tubular 1300. Multiple tubulars may be mechanically coupled end-to-end as shown in FIG. 3.

The engagement of the stab-in connector elements and the end surfaces of the tubular and the other tubular provides a pressure seal. The engagement of the first and second abutment surfaces, and the engagement of the internal screw thread of the connection sleeve and the external screw thread of the other tubular, provide secondary pressure seals.

Figure 4:
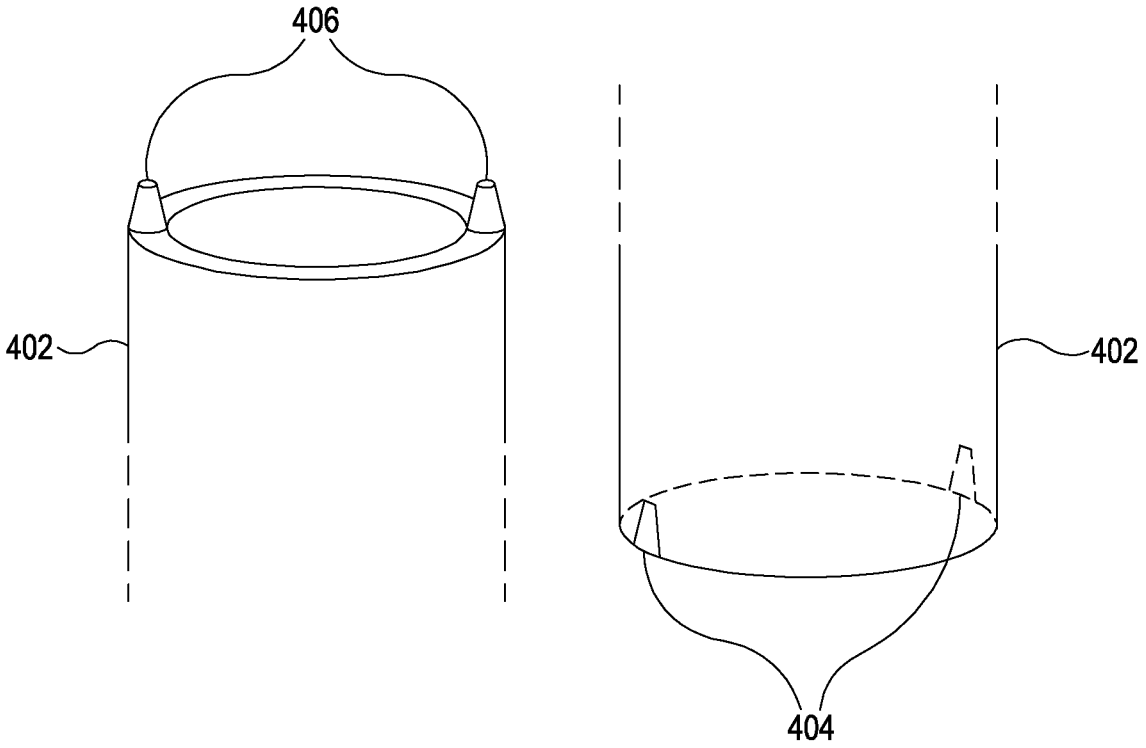
FIG. 4 shows stab-in connector elements of a tubular in accordance with the invention having complementary tapered shapes.

In an exemplary make-up procedure, starting from an uncoupled tubular e.g. as shown in FIG. 2 and ending with the coupled configuration shown in FIG. 3, the connection sleeve starts in the proximal position shown in FIG. 2, in which the internal screw thread is engaged with the first external screw thread. The tubular 300 is brought into proximity with another tubular 1300 and the stab-in connector elements 304 and 1306 are aligned to some extent. In FIGS. 1A, 1B, 2 and 3 the stab-in connectors have a substantially square or cylindrical shape. FIG. 4 shows an alternative embodiment in which the stab-in connector elements 404 at said end of the main body 402 have a tapered shape, and the complementary stab-in connector elements 406 at the other end of the main body 402 have a complementary tapered shape. The tapered shape of the stab-in connector elements provides more leeway for alignment of tubulars to be coupled in a make-up procedure. For example, a slight mis-alignment of square stab-in connector elements could potentially prevent engagement of the stab-in connectors, whereas tapered stab-in connector elements may permit engagement with a slight mis-alignment. The tapered shape may also provide an improved pressure seal relative to a square or cylindrical shape. Alternatively, the stab-in connector elements may simply enable alignment of the two tubulars, and a pressure seal may be provided by a circumferential seal area (e.g. a recessed lip and corresponding protruding portion as described below for FIG. 5A) radially outside of the stab-in connector elements. This will reduce the need for precise machining of the stab-in connector elements (which would be required to provide a pressure seal), and the pins may only have to engage with the corresponding sockets, rather than needing to bottom out inside the socket.

FIGS. 5A, 5B, 6A and 6B show the configuration of the stab-in connector elements and complementary stab-in connector elements in more detail for an embodiment.

Figure 5A:
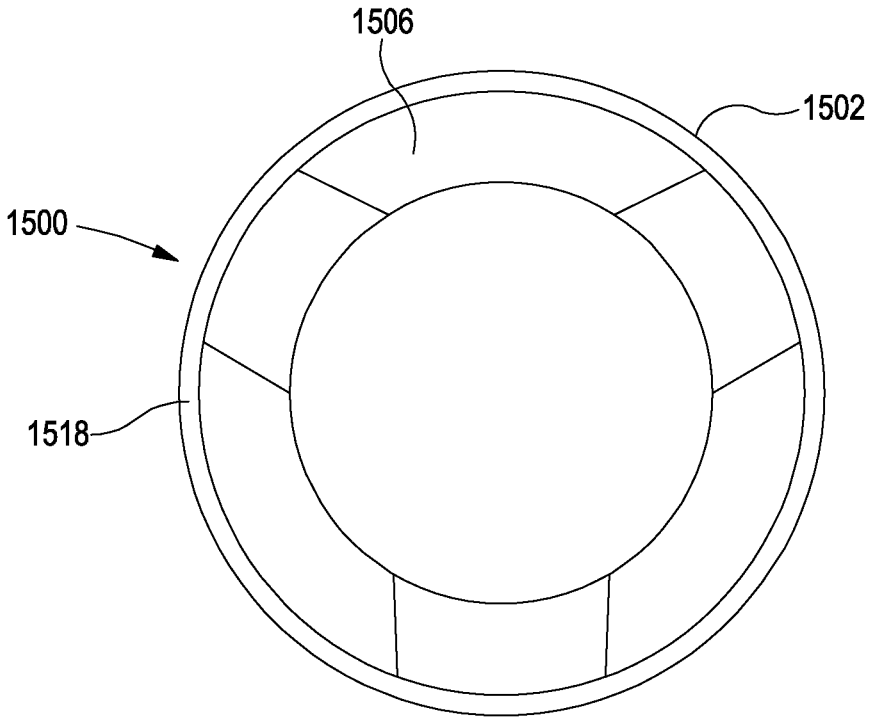
FIG. 5A shows an end-on view of a tubular having stab-in connector elements.

FIG. 5A shows an end-on view of other tubular 1500 having complementary stab-in connector elements 1506 (relative to tubular 600 and stab-in connector element 600 shown in FIGS. 6A and 6B, for which further details are set out below). The other tubular 1500 has a recessed lip 1518, which is recessed relative to the elongate main body 1502 of the other tubular 1500 and extends around the full circumference of the other tubular. The recessed lip is configured to engage with a corresponding protruding portion of a tubular, e.g. tubular 600, to provide a further pressure seal. The circumferential recessed lip 1518 is shown as being radially outward of the connector elements. In an alternative embodiment, the recessed lip is radially inward of the connector elements. In the embodiments shown in FIGS. 1A to 4, the other tubulars are not shown as having a recessed lip, and the tubulars are not shown as having a protruding portion configured to engage with the recessed lip to provide a pressure seal. However, in alternative embodiments said end of each of the tubulars shown in FIGS. 1A, 1B, 2, 3 and 4 includes such a recessed lip, and the other end of each tubular includes such a protruding portion, or vice versa.

Figure 5B:
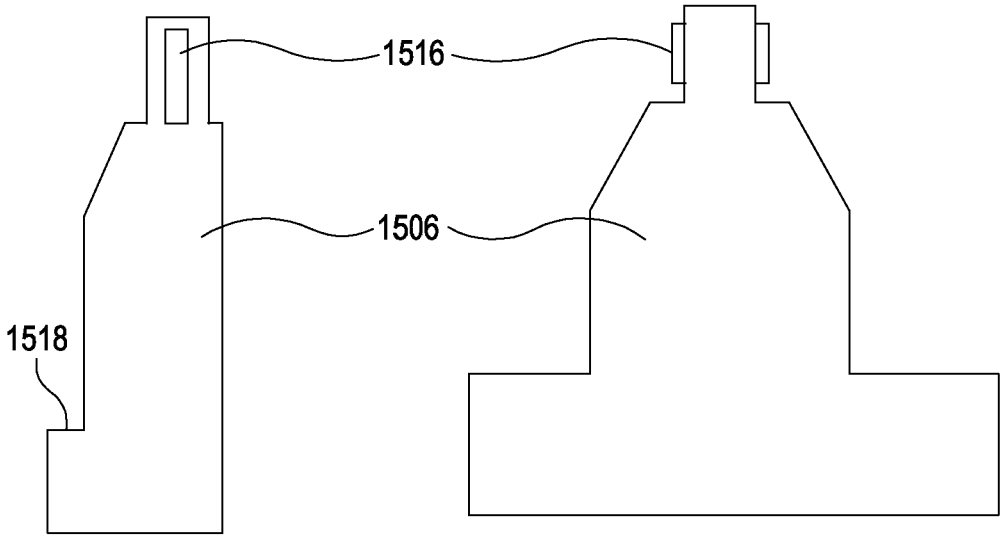
FIG. 5B shows side elevation views of a stab-in connector element in line with the embodiment of FIG. 5A.

FIG. 5B shows side-on and face-on elevations of a complementary stab-in connector element 1506, for the embodiment shown in FIG. 5A. The complementary stab-in connector element 1506 has a partially tapered shape that provides the same advantages as set out in relation to the embodiment of FIG. 4. At its distal end (i.e. distal from the elongate main body), the complementary stab-in connector element includes a complementary power and/or data connector 1516. In an embodiment, the complementary power and/or data connector 1516 is a contact made from e.g. metal, in particular copper, or any other suitable conductive material, which is configured to conduct electrical power and/or data. In the embodiment shown in FIG. 5B, the complementary power and/or data connector 1516 includes two substantially rectangular contact areas. The skilled person will understand that any suitable alternative arrangement may be used. For example, in another embodiment, the complementary power and/or data connector includes a single contact area that extends completely around the end portion of the complementary stab-in connector element.

Figure 6A:
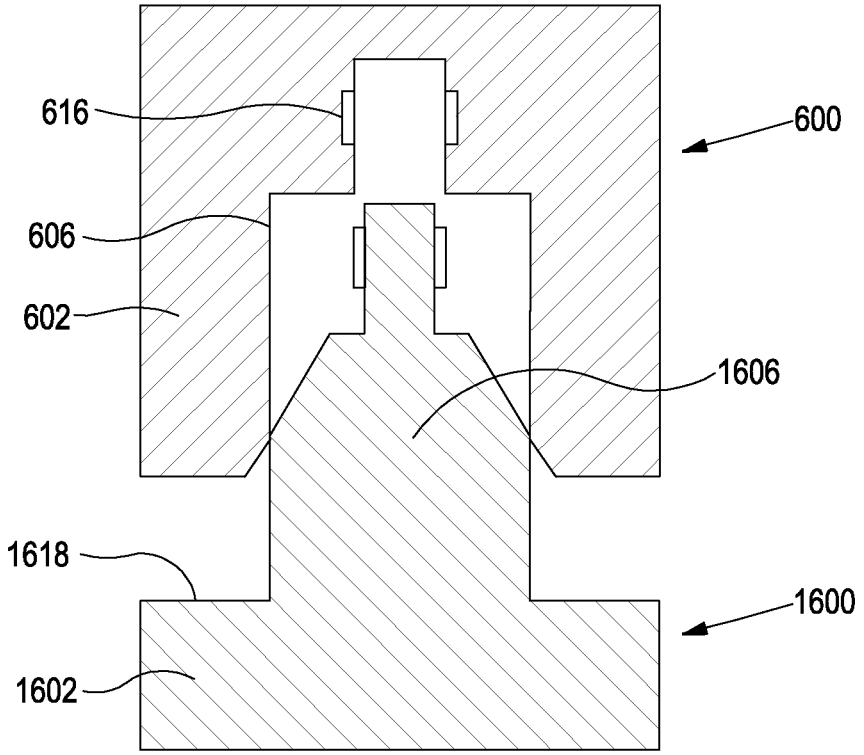
FIG. 6A shows a tubular and stab-in connector element of the embodiment of FIGS. 5A and 5B being brought into engagement with another tubular having a complementary stab-in connector element.

FIG. 6A shows a face-on elevation of the other tubular 1600 of the embodiment shown in FIGS. 5A and 5B in process of being brought into engagement with a tubular 600. In particular, the complementary stab-in connector 1606, which extends from elongate main body 1602 is in partial engagement with stab-in connector 606 of tubular 600, which includes elongate main body 602, and power and/or data connector 616. The stab-in connector 606 has a partially tapered profile which, in co-operation with the partially tapered shape of the complementary stab-in connector elements, provides the advantages as set out above in relation to FIG. 4.

Figure 6B:
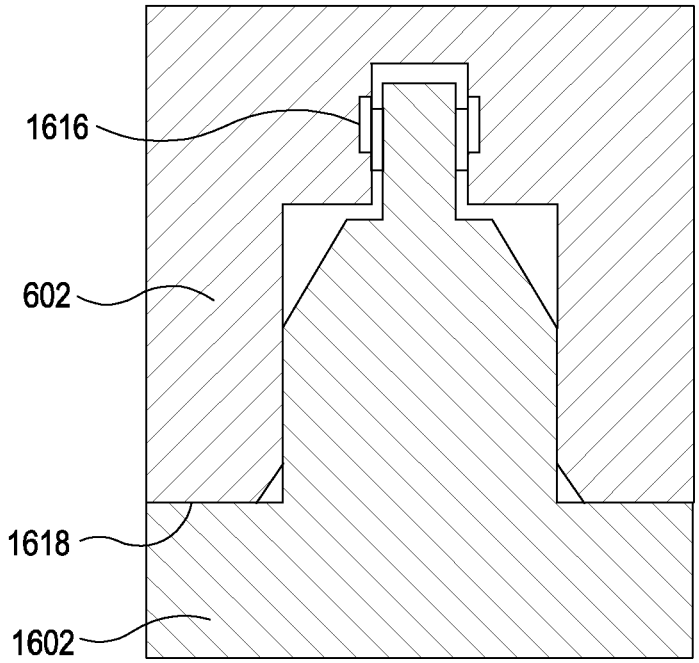
FIG. 6B shows the tubulars of 6A having been brought into full engagement.

FIG. 6B shows the tubular 600 and other tubular 1600 brought into full engagement, such that the recessed lip 1618 of the other tubular is in contact with the elongate main body 602 of the tubular, and the power and/or data connector 616 of the tubular is in contact with the complementary power and/or data connector 1616 of the other tubular.

In one embodiment the stab-in connector elements of the two tubulars are brought into engagement before the connection sleeve is moved from the proximal position. In an alternative embodiment the connection sleeve is moved from the proximal position to engage with an external screw thread of the other tubular before the stab-in connector elements of the two tubulars are brought into engagement, and the increasing engagement of the connection sleeve and the external screw thread of the other tubular is used to draw the stab-in connectors into engagement.

After the tubular 300 and the other tubular 1300 are brought into proximity with each other, and optionally into engagement with each other, the connection sleeve is rotated so that the connection sleeve moves in a distal direction, towards said end of the main body. At some point the internal screw thread disengages from the first external screw thread, and the connection sleeve drops down, or is lowered, to a position in which the internal screw thread can engage with the external screw thread of the other tubular. Because the connection sleeve disengages from the first external screw thread before engaging with the external screw thread of the other tubular, it is not necessary to consider the alignment of the two external screw threads. This makes the procedure of mechanically coupling tubulars simpler and more efficient. The connection sleeve is then rotated further to provide increasing engagement between the internal screw thread and the external screw thread of the other tubular, and to thereby bring the stab-in connector elements of the tubular and the corresponding stab-in connector elements of the other tubular into engagement, or into further engagement, and to provide an end-to-end pressure seal. The disengagement of the connection sleeve from the first external screw thread before engaging with the external screw thread of the other tubular therefore provides a further advantage in that it allows the two tubulars to be tightened against each other via increasing engagement of the internal screw thread with the external thread of the other tubular, which provides an improved pressure and/or hydraulic seal. In contrast, in a system where e.g. an internal thread of a connection sleeve is in engagement with external threads of both tubulars, increasing engagement between the internal thread and the external thread of the other tubular cannot increase the force with which the tubulars are brought together. The improved pressure/hydraulic seal may allow abutting joints to be, for example, metal/metal contact (whereas a gasket might otherwise be required), which may reduce the need for maintenance or repair. Of course, such a gasket may be used in the present invention. Once mechanically coupled, the tubulars are ready for transmission of electrical data and/or power via the stab-in connection. With the possible exception of minimal rotation for alignment, it is not necessary to rotate the main body of the tubular during the make-up procedure. Neither is rotation required during a corresponding break-out procedure.

The Figures relate to a coupling procedure in which the connection sleeve is at a lower end of the tubular, and the connection sleeve is used to mechanically couple the tubular to another tubular below the tubular. Whilst typical make-up and break-out procedures relate to such downward coupling, it is also possible for the connection sleeve to be located at an upper end of the tubular and to be used to couple to another tubular above the tubular.

FIG. 7 shows a high-level flow diagram describing a method of mechanically coupling a tubular to another tubular in accordance with the invention, where the tubular comprises an elongate main body, a stab-in connector element located at an end of the main body, and a rotatable connection sleeve disposed coaxially around a first end portion of the main body at or near said end of the main body, and the other tubular comprises a complementary stab-in connector element. In step S702, the connection sleeve is used to provide a mechanical coupling between the tubular and the other tubular without requiring rotation of the main body, to thereby provide a stab-in connection between the stab-in connector element of the tubular and a complementary stab-in connector element of the other tubular for electrical power and/or data transmission.

It will be appreciated by the person of skill in the art that various modifications may be made to the above described embodiments without departing from the scope of the present invention.

The invention claimed is:

1. A tubular for use in the creation or completion of, or production from, an oil and/or gas well, comprising:

an elongate main body;

a stab-in connector element located at an end of the main body;

a rotatable connection sleeve disposed coaxially around a first end portion of the main body at or near said end of the main body; and a first external screw thread in the first end portion, wherein the first external thread is configured to engage with an internal screw thread of the connection sleeve to retain the connection sleeve in place on the main body, wherein the connection sleeve is configured to provide a mechanical coupling between the tubular and another tubular without requiring rotation of the main body, to thereby provide a stab-in connection between the stab-in connector element of the tubular and a complementary stab-in connector element of the other tubular for electrical power and/or data transmission, and wherein the internal screw thread of the connection sleeve extends a distance from a distal end of the connection sleeve such that, when the stab-in connector element of the tubular and the complementary stab-in connector element of the other tubular are engaged and the internal screw thread is engaged with an external thread of another tubular, the internal screw thread is not engaged with the first external thread of the tubular.

2. The tubular according to claim 1, wherein the internal screw thread of the connection sleeve extends a distance from the distal end of the connection sleeve such that, when the stab-in connector element of the tubular and the complementary stab-in connector element of the other tubular are fully engaged and the internal screw thread is engaged with the external thread of another tubular, the internal screw thread is not engaged with the first external thread of the tubular.

3. The tubular according to claim 1, further comprising:

a first shoulder located at the first end portion of the main body and extending radially outward from the first end portion to provide a first abutment surface, wherein the connection sleeve is longitudinally movable relative to the main body, and the connection sleeve comprises:

the internal screw thread; and a second shoulder located at a proximal end portion of the connection sleeve and extending radially inward from an inner surface of the connection sleeve to provide a second abutment surface that is configured to engage with the first abutment surface, wherein the mechanical coupling is provided by rotating the connection sleeve to engage the internal screw thread of the connection sleeve with an external screw thread of the other tubular, to thereby draw the stab-in connector element of the tubular into engagement, or further engagement, with the complementary stab-in connector element of the other tubular.

4. The tubular according to claim 1, further comprising:

a complementary stab-in connector element located at the other end of the main body; and a second external screw thread in a second end portion of the main body at or near the other end of the main body.

5. The tubular according to claim 1, wherein the stab-in connector element of the tubular is a male plug or pin, or a female socket, and wherein the complementary stab-in connector element is a corresponding female socket or a male plug or pin.

6. The tubular according to claim 1, wherein the stab-in connector element and the complementary stab-in connector element have complementary tapered shapes.

7. The tubular according to claim 1, further comprising, at said end of the main body, a circumferential recessed lip that is configured to engage with a corresponding protruding portion of another tubular to provide a pressure seal.

8. The tubular according to claim 1, wherein the tubular is a drill pipe section, a production tubing section, a liner section, or a casing section.

9. The tubular string comprising a plurality of tubulars according to claim 1 mechanically coupled end-to-end.

10. A method of mechanically coupling a tubular to another tubular, wherein the tubular comprises an elongate main body, a stab-in connector element located at an end of the main body, a rotatable connection sleeve disposed coaxially around a first end portion of the main body at or near said end of the main body, and a first external screw thread in the first end portion, wherein the first external thread is configured to engage with an internal screw thread of the connection sleeve to retain the connection sleeve in place on the main body, and wherein the other tubular comprises a complementary stab-in connector element, the method comprising:

using the connection sleeve to provide a mechanical coupling between the tubular and the other tubular without requiring rotation of the main body, to thereby provide a stab-in connection between the stab-in connector element of the tubular and a complementary stab-in connector element of the other tubular for electrical power and/or data transmission, wherein the internal screw thread of the connection sleeve extends a distance from a distal end of the connection sleeve such that, when the stab-in connector element of the tubular and the complementary stab-in connector element of the other tubular are engaged and the internal screw thread is engaged with an external thread of the other tubular, the internal screw thread is not engaged with the first external thread of the tubular.

11. The method according to claim 10, wherein the internal screw thread of the connection sleeve extends a distance from the distal end of the connection sleeve such that, when the stab-in connector element of the tubular and the complementary stab-in connector element of the other tubular are fully engaged and the internal screw thread is engaged with the external thread of another tubular, the internal screw thread is not engaged with the first external thread of the tubular.

12. The method according to claim 10, the tubular further comprising a first shoulder located at the first end portion of the main body and extending radially outward from the first end portion to provide a first abutment surface, wherein the connection sleeve is longitudinally movable relative to the main body, the connection sleeve comprising the internal screw thread, and a second shoulder located at a proximal end portion of the connection sleeve and extending radially inward from an inner surface of the connection sleeve to provide a second abutment surface that is configured to engage with the first abutment surface, and the other tubular further comprising an external screw thread, wherein using the connection sleeve to provide a mechanical coupling between the tubular and the other tubular comprises:

rotating the connection sleeve to engage the internal screw thread of the connection sleeve with the external screw thread of the other tubular, to thereby draw the stab-in connector element of the tubular into engagement, or further engagement, with the complementary stab-in connector element of the other tubular.

* * * * *